United States Patent [19]

Marlo

[11] Patent Number: 4,471,956

[45] Date of Patent: Sep. 18, 1984

[54] BENCH PRESS LIFTING AID

[76] Inventor: Stephen M. Marlo, 4311 Briggs Chaney Rd., Beltsville, Md. 20705

[21] Appl. No.: 412,967

[22] Filed: Aug. 30, 1982

[51] Int. Cl.[3] ..... A63B 21/06

[52] U.S. Cl. ..... 272/123; 272/134; 272/144; 272/117

[58] Field of Search ..... 272/116–118, 272/123, 134–136, 144; 128/25 R

[56] References Cited

U.S. PATENT DOCUMENTS

| | | | |
|---|---|---|---|
| 4,249,726 | 2/1981 | Faust | 272/123 |
| 4,253,662 | 3/1981 | Podolak | 272/123 |
| 4,324,398 | 5/1982 | Hole | 272/123 |

*Primary Examiner*—Richard J. Apley

*Assistant Examiner*—Chris Coppens

[57] ABSTRACT

The weight lifting aid is a system of cables and pulleys which serves two purposes: (1) it provides an upward force to the bar, (2) it prevents the bar from falling onto the weight lifter's body. The upward force is activated by stepping on a lever next to the bench. This lever will open the jaws of a clamp which releases a cable holding a weight. The falling weight pulls on another cable which aids in counteracting the weight being lifted. In the event that the falling weight is not capable of counteracting the weight being lifted, a safety feature prevents the weight from falling below the weight lifter's chest. The safety feature is an enlargement in the cable which limits the movement of the cable through the pulley.

5 Claims, 2 Drawing Figures

BENCH PRESS LIFTING AID

BACKGROUND OF INVENTION

The weight lifting aid is intended for use in all situations where the weight lifter could be trapped beneath the barbell. The bench press is the most applicable exercise.

Bench pressing requires a weight lifter to lie on a bench under a selected amount of weight. The weight is then lifted off the rack (attached to the bench) and brought down to the weight lifter's chest. Then, he must return the weight to the racks. It is obvious that if the weight lifter is not capable of returning the weight to the bench, he is in serious trouble.

On many occasions I have found myself in such a situation and have barely escaped without injury. In this situation the weight was only a few pounds over my maximum lift. Therefore, with the help of an upward force of a few pounds, the lift could have been completed successfully.

Even with a partner it is possible to substain a serious injury from the weight. I have witnessed a weight lifter, while bench pressing, accidentally drop the weight on his head. He was in a room with approximately ten other weight lifters.

It is my opinion that a safety device should be used to prevent the possibility of such injuries from occuring.

SUMMARY OF THE INVENTION

The present invention provides the minor assistance needed in case you can't make the lift when you are benching a few pounds over your maximum. This is accomplished by stepping on a lever next to the bench. The lever opens the jaws of a clamp which releases a cable holding a weight. This weight is transfered to another cable attached to the bar. The falling weight creates the upward force necessary to assist the lift.

This invention contains a safety knot in the cable which limits downward movement of the bar. The knot is place before the pulley closest to the bench. This will prevent the bar from falling onto the weight lifter's body.

DESCRIPTION OF THE INVENTION

Figure 1:
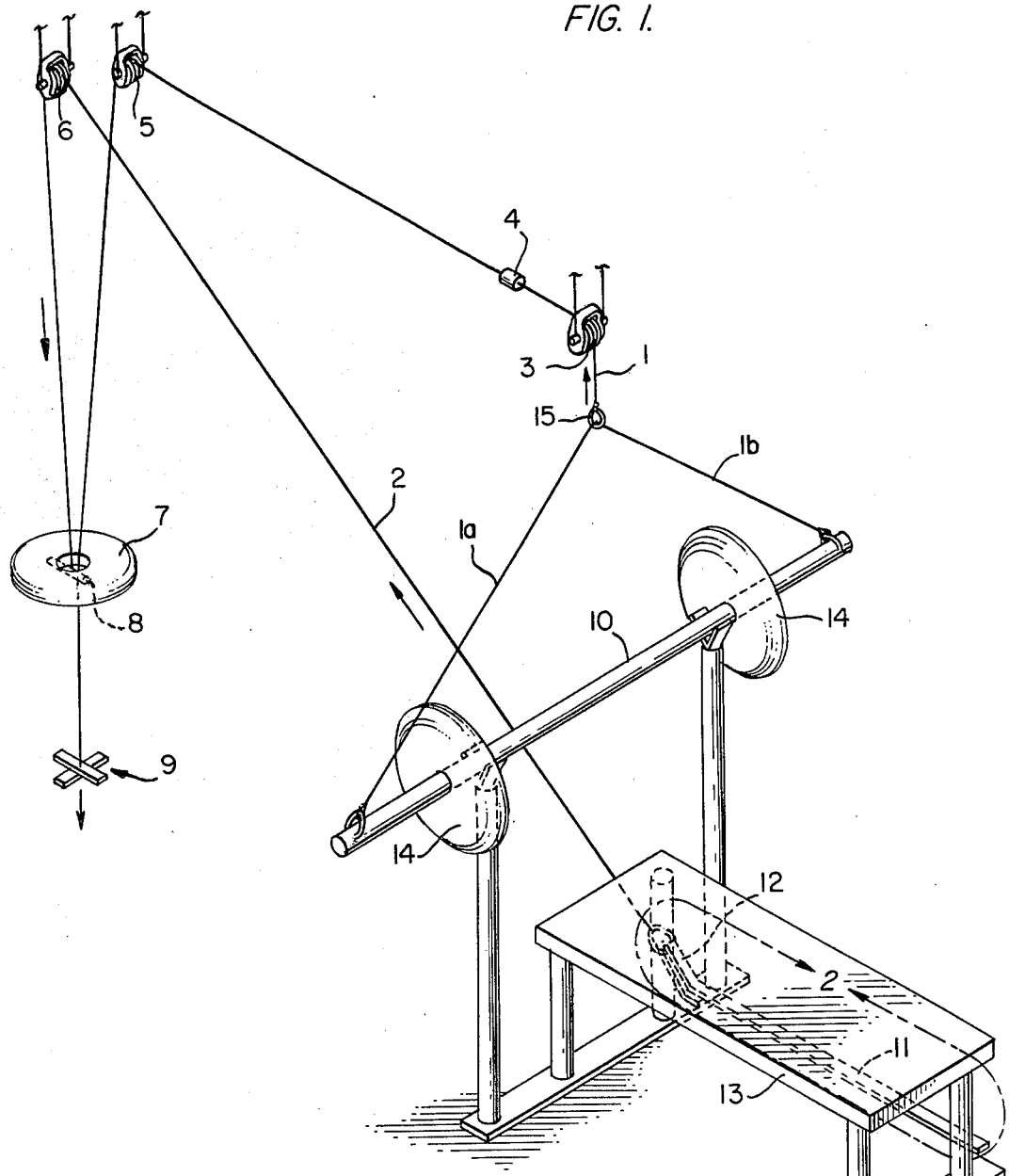
FIG. 1 is a perspective view showing a typical arrangement of the device.
Figure 2:
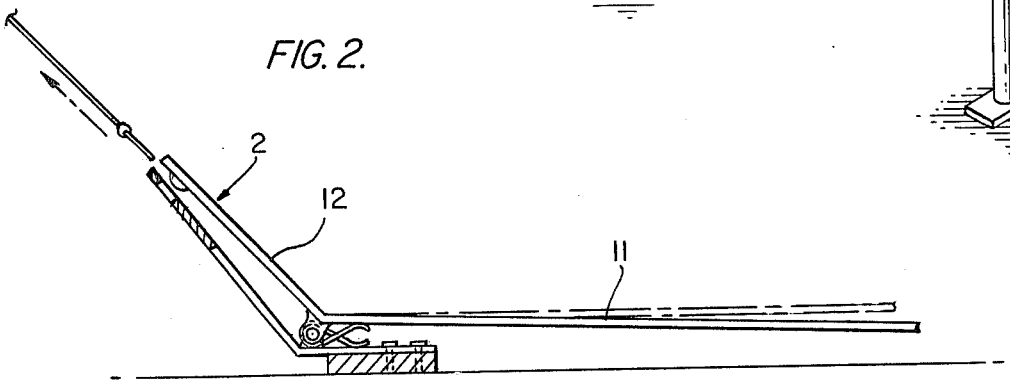
FIG. 2 is an enlarged view of the release latch.

A device which will assist a weight lifter doing a bench press, in the event the lifter is unable to complete the press because the lifter is simply too weak or not psyched up to lift the amount of weight being attempted. The device includes three ceiling mounted pulleys 3, 5, and 6; four cables 1, 1*a*, 1*b*, 2, and a cable latch 12. Cable 1 extends from an abutment 9 at the first end, through a counter-weight 7, to pulleys 5 and 3, then to a connection with second and third cables 1*a* and 1*b* at ring 15. Cables 1*a* and 1*b* extend from a connection at ring 15 of the barbell 10 where they are secured. The fourth cable 2 extends from a latch 12 near the bench 13, through pulley 6, then is connected to a weight step 8 at the other end of the cable, which holds the counter weight suspended in air. As the lifter lowers the barbell downward, cable 1 is pulled freely through the first pulley. If the barbell is accidentally dropped, or simply lowered too far because of a sudden weakness in the lifter, a protuberance 4 on the first cable 1 engages the pulley 3 and stops any downward movement of the cable 1 and barbell 10 thus protecting the lifter from injury. If the lifter feels he needs some minor assistance to press the weight being attemped, he can trip the cable latch 12 connected to bench 13, using his feet. When the latch 12 is tripped, the end of cable 2 is released and counter-weight 7 is then free to drop downward and engage the abutment 9 on the end of cable 1. The counter-weight then tends to lift the barbell off the lifter, but being much lighter than the weight being benched, actually provides only a minor lifting assistance to the lifter, which is all he wanted anyway.

The release latch can be made in many different ways. The one I have made and tested was a simple ordinary spring clamp similar to a spring clamp clothes pin, of the type used by woodworkers, being an all steel construction and having a relatively great clamping force. When the jaws of the clamp are opened, the clamp releases its hold on the end of cable 2 and the cable 2 is then freely pulled downward due to the force exerted by counter weight 7. Obviously, any other suitable release clamp may be used, so long as it can both hold and easily release the end of cable 2.

I claim:

1. An aid for athletes performing weight lifting exercises comprising a first cable including means for forming a stop at the first end thereof, and means for attaching the second end thereof to a weight to be lifted by an athlete, a second cable including means for forming a stop at the first end thereof, and means at the second end thereof for being gripped by a latch, and a latch for releaseably gripping and holding said second end of said second cable when a counter-weight of predetermined value is supported by the stop at the first end of said second cable, the length of said first and second cables being such that each of said cables may be supported generally midway of its length by a pulley support located generally above the athlete performing the lifting exercise, while the second end of the first cable is attached to a weight being lifted by the athlete and the stop on the first end of the first cable is hanging freely, and the second cable has the second end thereof connected to said release latch, said latch being located adjacent the weight being lifted and in proximity to the lifter while the stop on the first end of said second cable is hanging freely at an elevation above the freely hanging stop on the first cable, whereby the athlete while attempting to lift a weight may actuate said release latch to release said second cable and enable a counter weight on the stop of said second cable to fall onto the stop of said first cable and assist the lifter in lifting a weight at the second end of the first cable.

2. The aid of claim 1 wherein the first cable includes means for forming a protuberance generally midway of its length to engage a pulley support and limit the downward movement of said first cable when a weight is attached to the second end of said first cable to provide a safety feature for the athlete attempting to lift said weight.

3. In a device for performing a bench press exercise, an elevated cable support above said device, a first cable connected to the barbell, a second cable carrying a weight, and a release latch, means for supporting said cables on said elevated support and means for mounting said release latch in a cooperative manner so that an athlete may actuate said release latch while doing a bench press exercise and enable the weight on said second cable to be transferred to said first cable and exert a lifting force on said barbell to aid the athlete performing the bench press exercise.

4. A device for use with weight lifting apparatus used by an athlete while doing a bench press exercise including means operable by an athlete while doing a bench press exercise for transferring a weight of predetermined value from a first cable to a second cable, and means for connecting said second cable to a barbell being bench pressed by an athlete so that said weight, when transferred to said second cable, exerts a lifting force on said barbell, and thereby assists the athlete in lifting said barbell and any other weights thereon.

5. The device of claim 4 in combination with apparatus used by an athlete for doing a bench press exercise, said apparatus comprising a bench and two horizontally spaced apart barbell support racks on opposite sides of and adjacent one end of said bench for supporting opposite end portions of the barbell above said bench when said barbell is not being lifted by the athlete.

* * * * *